United States Patent [19]

Austin

[11] Patent Number: 4,634,352

[45] Date of Patent: Jan. 6, 1987

[54] CEMENT PUMP WITH VALVE MANIFOLD CONTROL

[76] Inventor: Richard D. Austin, 18414 Buckthorne Rd., Devore, Calif. 92407

[21] Appl. No.: 752,552

[22] Filed: Jul. 8, 1985

[51] Int. Cl.[4] ..... F04B 21/02; F04B 15/02

[52] U.S. Cl. ..... 417/531; 417/900

[58] Field of Search ..... 417/531, 900

[56] References Cited

U.S. PATENT DOCUMENTS

| | | | |
|---|---|---|---|
| 25,642 | 10/1859 | Henderson | 417/531 |
| 38,291 | 4/1863 | Davis | 417/531 |
| 1,991,342 | 2/1935 | Ball | 417/531 |
| 2,734,667 | 2/1956 | Conklin | 417/900 |
| 3,787,149 | 1/1974 | Dane | 417/566 |
| 3,910,730 | 10/1975 | Gage | 417/554 |
| 3,994,631 | 11/1976 | Hostetter | 417/900 |
| 4,067,666 | 1/1978 | Richards | 417/900 |
| 4,521,163 | 6/1985 | Stahlkopf | 417/900 |

FOREIGN PATENT DOCUMENTS

| | | | |
|---|---|---|---|
| 591609 | 2/1978 | U.S.S.R. | 417/900 |

*Primary Examiner*—Carlton R. Croyle
*Assistant Examiner*—Paul F. Neils
*Attorney, Agent, or Firm*—Brown, Martin, Haller & Meador

[57] ABSTRACT

A pump for applying pre-mixed cement, and similar mud-like flowable materials, employs power driven oppositely reciprocating pistons sliding in a pair of cylinders for pumping action. A control manifold, having a single cement discharge outlet, interconnects combined suction and discharge outlets of each pump cylinder with a cement supply hopper manifold inlet. Two manifold pump response chambers, and a single discharge chamber in flow communication with one another within the manifold, together with associated valving within each chamber, provides for unidirectional flow of cement under pressure from the manifold discharge outlet solely in response to the movement of the pistons within the pump cylinders. The pump response chamber valves have adjustable valve openings so that the pump may be employed with flowable materials of varying viscosity.

4 Claims, 5 Drawing Figures

CEMENT PUMP WITH VALVE MANIFOLD CONTROL

BACKGROUND OF THE INVENTION

The construction of buildings, walls, pools and like structures is greatly facilitated by being able to inject or apply pre-mixed cement, or similar flowable materials of mud-like viscosity, under pressure at the construction site. Pumps employing various types of impellers, augers and similar mechanisms have been used to accomplish this function. Reciprocating piston concrete pump designs are disclosed in the applicant's U.S. Pat. No. 4,174,928, and in the patent to Schwing, U.S. Pat. No. 3,146,721.

For pumping cement, a pump which requires close tolerance fits between parts, or which depends on complex interconnections between pump components and parts of the flow material distribution system for proper operation is difficult to use and maintain. Cement and other such water mixture materials tend to clog any device with which they come in contact, and if permitted to set can render the pump inoperative. It is desirable, therefore, that a cement pump be of simple design and construction with few moving parts, and without intricate control features. Also, since different jobs require the use of pre-mixes having different water content, and therefore having different viscosity and drying characteristics, it is desirable to have a pump capable of readily accommodating different flow materials. In addition, such a pump should be compact and transportable, yet be of sturdy construction, reliable in operation, and easily maintained. Applicant's cement pump meets theses and other requirements.

SUMMARY OF THE INVENTION

According to the precepts of the invention, a portable cement pump is disclosed in which control of a premixed cement flow to, and discharge from, the pump installation is achieved by a manifold with internal compartmentation and valving. In the embodiment illustrated, reciprocating pump action is supplied by a pair of parallel spaced apart cylinders, each of which has a single combined cyinder suction and discharge connection, and a piston slidable in the cylinder. Power drive means connected to the pistons provides for simultaneous opposite reciprocating movement of the pistons within their respective cylinders. That is, a suction stroke in one pump cylinder is accompanied by a simultaneous discharge stroke in the other cylinder of the pair. A control manifold interconnects a pre-mixed cement supply source, a gravity feed hopper in the illustrated embodiment, the cylinder suction and discharge connections, and a manifold cement discharge outlet connection to which an applicator hose may be attached. The control manifold is formed with three internal chambers. Two separate pump response chambers are located adjacent to one end of the manifold. A single discharge chamber is formed at adjacent the opposite end of the manifold. Each of the control manifold pump response chambers is in material flow communication with the discharge chamber which is equipped with a pump installation discharge connection. Each of the pump response chambers has a first manifold connection which mates with a suction and discharge connection of one of the pump cylinders, and a second manifold connection providing flow communication with the cement supply hopper outlet. The flow of material between the hopper and a cylinder through a pump response chamber is controlled by a vertically moveable pump response valve having the form of a metal ball, and having an annular spherical valve seat formed adjacent to the manifold hopper inlet connection. The valve ball is free to move in response to pump action in its associated chamber, opening on a piston suction stroke, and closing on a discharge stroke. As a consequence of the simultaneous opposite operation of the pump pistons, when one of the pump response valves is closed, the other one is open. The opening of a pump response ball valve is adjustable to permit pumping of material of different viscosity by changing the length of permitted ball travel away from its seated position.

Passages connect the two pump response chambers of the control manifold with the discharge chamber. Each passage is provided with annular spherical valve seat member having a seat oriented toward the discharge chamber. A ball shaped isolation valve free to move within the discharge chamber, seats against one or the other of the latter valve seats to open and close the passages to the discharge chamber alternately under the influence of the oppositely acting strokes of the pump pistons. The pump response valves and the isolation valve function in cooperative relationship to maintain unidirectional cement flow through the manifold. During the discharge stroke of one pump cylinder, cement flow is directed through the connected manifold pump response chamber and into the discharge chamber via the passage connecting these chambers. The ball valve of the pump response chamber is closed by cement flow and seals off the associated hopper inlet. Cement flow within the discharge chamber forces the isolation valve ball against the valve seat of the opposite passage to close the intermediate passage of the opposite cylinder during its suction stroke. The cement under pressure also flows through the manifold discharge chamber outlet connection for use. An annular shoe of appropriate dimensions positioned adjacent the manifold discharge outlet prevents the loss of the isolation valve ball from the discharge chamber.

The primary advantage of the invention is the provision of a new and improved cement pump. The pump installation is of sturdy construction, compact and of relatively small size. The flow of cement or similar material from the pump is automatically controlled by a valve manifold to provide unidirection flow under pressure of cement in response to pump operation. The pump is of simple construction and thus easily operated, cleaned, and maintained. It is also readily adapted to pumping of flowable materials of varying viscosity by a simple adjustment. These together with other advantages of the invention will become more apparent in considering the details of construction and operation of the cement pump as they are more fully described. Reference will be made to the accompanying drawings wherein like numerals refer to like parts throughout.

DETAILED DESCRIPTION OF THE DRAWING

Figure 1:
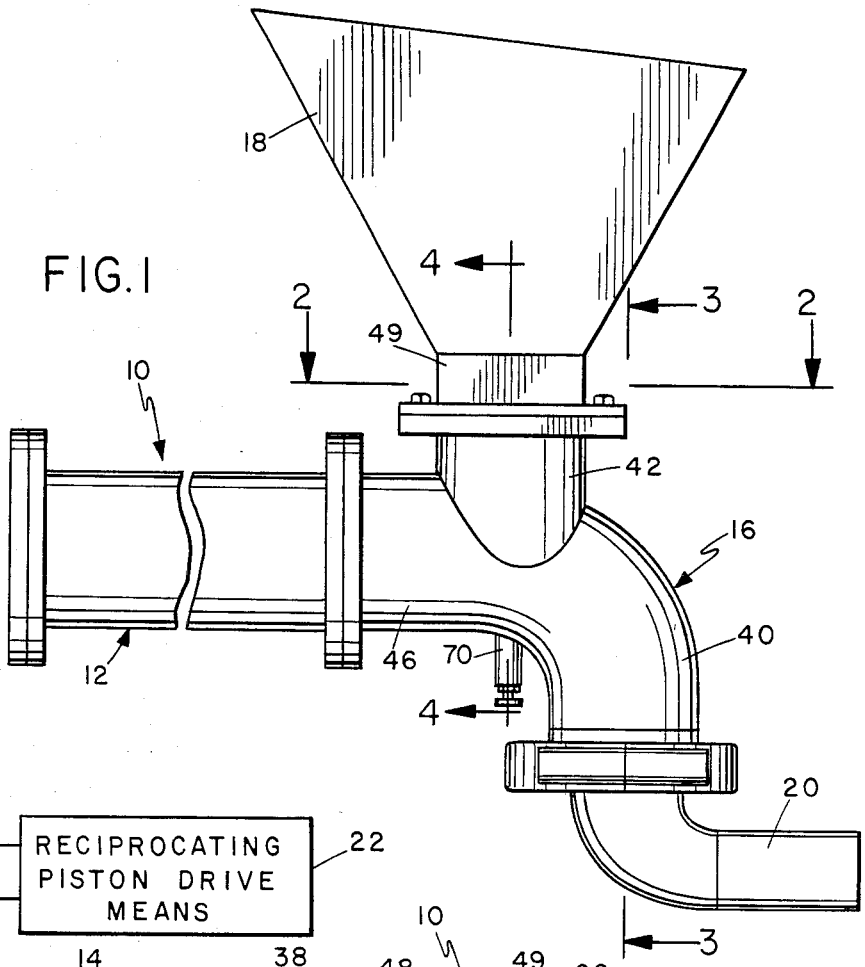
FIG. 1 is a side elevation view of the concrete pump and valve manifold.
Figure 2:
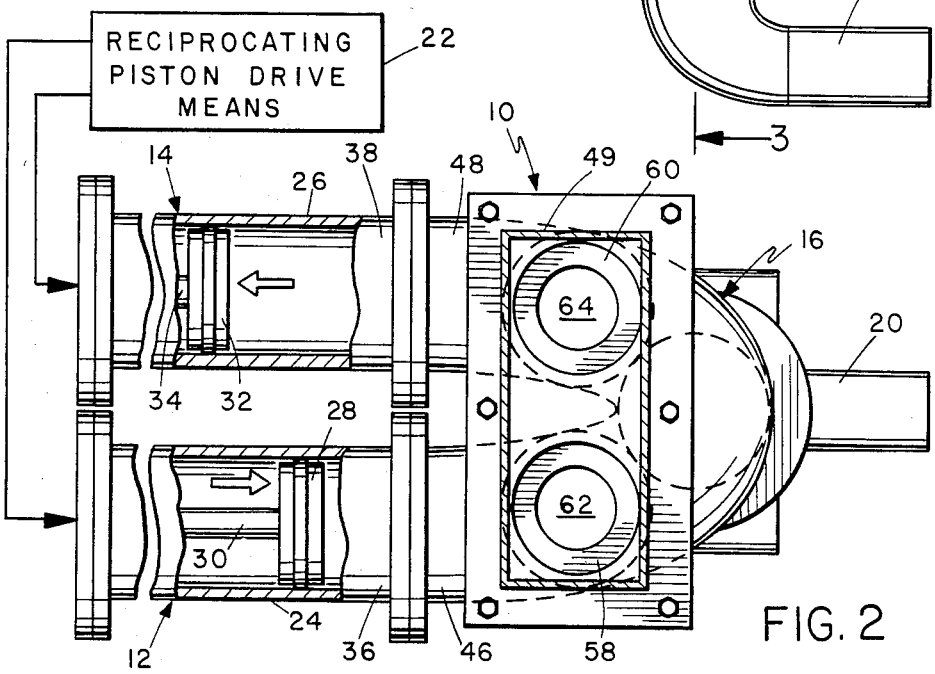
FIG. 2 is a sectional view taken on line 2—2 of FIG. 1.

The external configuration of the pump 10 of the present invention is illustrated in FIGS. 1 and 2. The principal interconnected components of the embodiment illustrated include: a pair of reciprocating piston pumps 12 and 14, a control manifold 16, a pre-mixed concrete supply hopper 18, and a discharge pipe 20. A pump piston drive means 22 is illustrated schematically. The later equipment may be of any suitable design which will cause the pistons of pumps 12 and 14 to have alternate and opposite suction and discharge strokes. The piston drive means, together with pump 10 may be mounted upon a truck or vehicle trailer, not shown, for transport to and use at a construction site.

Figure 3:
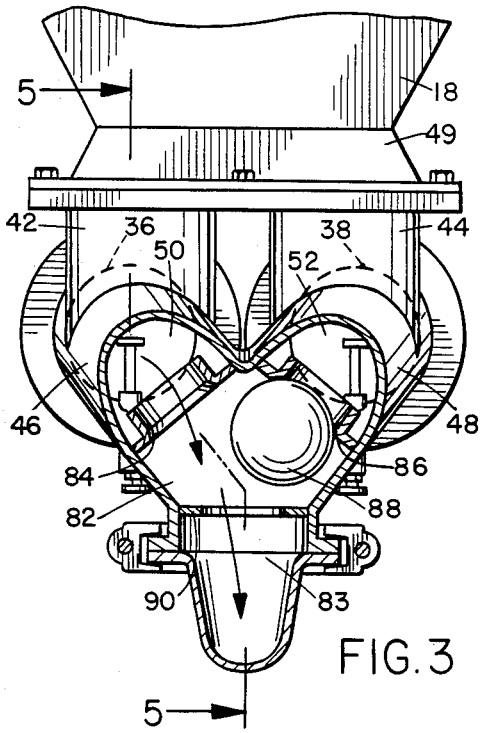
FIG. 3 is a sectional view taken on line 3—3 of FIG. 1.

The pumps 12 and 14 include pump cylinders 24 and 26 respectively, arranged horizontally in spaced parallel relationship to one another. Piston 28 with an attached piston rod 30 moves with reciprocating motion with cylinder 24, while piston 32 with a piston rod 34 moves similarly within cylinder 26. Pistons 28 and 32 are caused to move in opposite directions by the piston drive means 22 connected to the piston rods 30 and 34. The pump cylinders 24 and 26 have flanged outlets 36 and 38 respectively at the ends of the cylinders (FIG. 3). The outlets 36 and 38 serve as both a suction and a discharge connection for their respective pumps 12 and 14. In the pump installation described, the pistons have a stroke of 36 inches, and the pumps develop a flowable material pressure of 700 pounds per square inch.

A control manifold 16 is formed of welded six inch inside diameter cylindrical steel pipe sections, but it should be understood that the manifold 16 could be made from other material and otherwise formed, as by casting. Viewed generally from the side, the manifold 16 appears as a flanged elbow shaped member 40 with a riser sections 42. As illustrated in FIG. 2, in front elevation, the manifold 16 appears as an upright Y-shaped member with the two arms of the Y inclined away from the observer.

Figure 4:
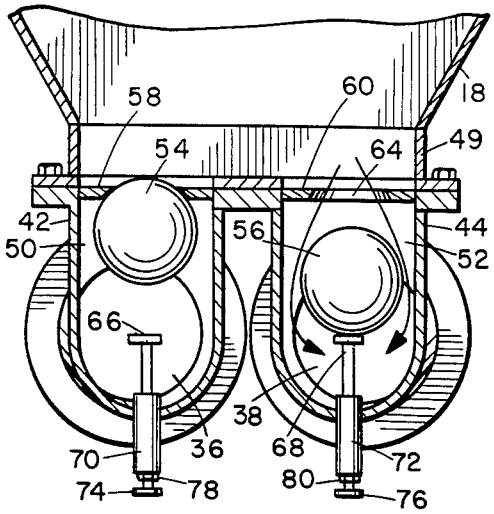
FIG. 4 is a sectional view taken on line 4—4 of FIG. 1.

The construction of the control manifold 16 and its connections are further illustrated in FIGS. 2, 3 and 4. The interior of the arms 46 and 48 of the Y-shaped portions of the manifold, together with their corresponding riser sections 42 and 44, form two pump response chambers 50 and 52 within the manifold 16. A hopper 18 has a single outlet connection 49 of rectangular shape. Chamber 50 is in material flow communication with the suction and discharge opening 36 of pump cylinder 24 and the hopper outlet connection 49 via a circular manifold inlet 62. The interior of the pump response chamber 52 is in material flow communication with the section and discharge outlet 38 of pump cylinder 26 and the hopper outlet connection 49 via a circular opening 64. The flow of pre-mixed cement from the hopper 18 to the cylinders 24 and 26 through the separate manifold response chambers is governed by the positions of ball shaped valves 54 and 56 within the chambers 50 and 52. The valve balls seat against annularly shaped spherical valve seats 58 and 60 at the manifold openings 62 and 64 in response to cement flow under pressure into the chambers 50 and 52 to close the manifold hopper inlets.

The valve balls 54 and 56 are free to move vertically in response to material flow within their respective pump response chambers, but are constrained horizontally by the interior walls of the risers 42 and 44. The valve balls 54 and 56 are formed of metal, have a diameter of four inches, and weigh two and one half pounds apiece. The valve seats 58 and 60 have a flow opening of three and one-half inches. To permit the pumping of cement, or flow materials of varying water content, or viscosity, with the same pump installation, the allowed vertical travel of the valve balls 54 and 56, and thus the manifold inlet opening from the hopper 18, is made adjustable. In the illustrated design this adjustment is achieved through use of manually positioned valve ball stops 66 and 68, but it shoud be recognized that other stop positioning designs could be employed. The stops 66 and 68 are threadable through sleeves 70 and 72 which penetrate from the exterior of the manifold 16 into the manifold pump response chambers 50 and 52 below the valve balls 54 and 56. The position of the ball stops below the valve seats 58 and 60 is adjustable by rotating the stops with the exterior grips 74 and 76. Lock nuts 78 and 80 secure the position of the valve ball stops in the sleeves 70 and 72. Experience has shown that an adjustment of one inch in the travel of the valve balls provides sufficient flexibility for varying pump usage.

Figure 5:
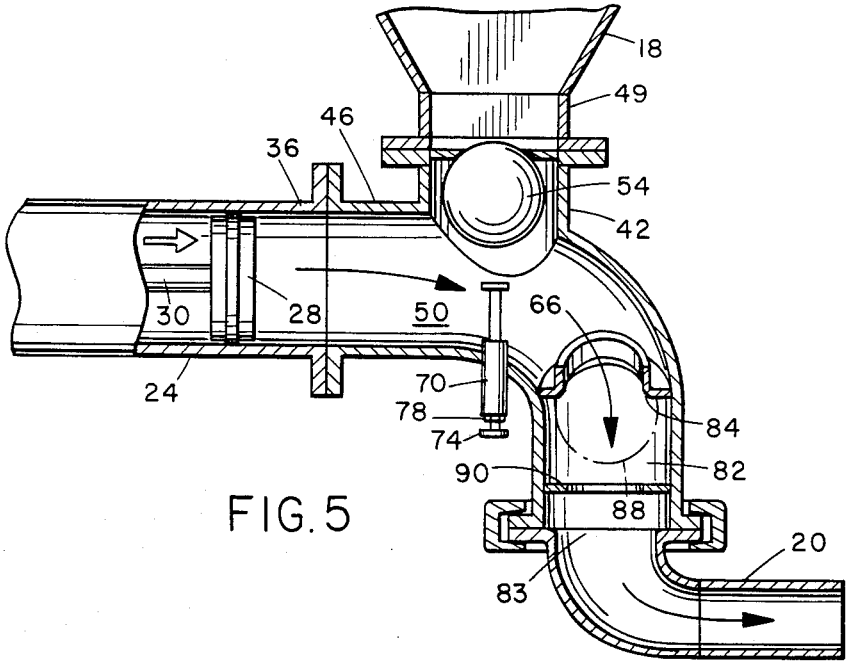
FIG. 5 is a sectional view taken on line 5—5 of FIG. 3.

As illustrated in FIGS. 3 and 5, the two pump response chambers 50 and 52 are each connected in flow communication with a common manifold discharge chamber 82 via inclined annularly shaped discharge chamber isolation balve seat members 84 and 86 positioned in the manifold 16 so as to terminate the passage between the pump response chambers 50 and 52 and the discharge chamber 82. The discharge chamber has a single outlet opening 83 flanged for attachment to a pump installation outlet discharge pipe 20. The discharge pipe 20 may be is connected to an air accumulator which smooths the pump discharge pulsation, and to a flexible hose to apply the cement. These latter equipments, are not illustrated.

The valve seat of members 84 and 86 are spherical in shape about circular openings of three and one-half inches in diameter in the members, and are oriented toward the the discharge chamber 82. A discharge chamber isolation valve ball 88 within the discharge chamber is free to move generally horizontally within the discharge chamber 82 in response to material flow passing through either of the discharge chamber isolation valve seat members 84 and 86. The valve ball 88 seats against the discharge isolation valve seat opposite to the one through which material is flowing, thus closing that entry to the discharge chamber 82. In FIG. 5, the discharge chamber isolation valve ball 88 is shown broken line to indicate its presence within the discharge chamber 82. The discharge chamber isolation ball 88 is of the same size and construction as the manifold pump response chamber valve balls. To prevent the loss of the isolation valve ball 88 through the discharge chamber outlet opening 83, an annularly shaped shoe 90, having a circular opening with a diameter less than that of the valve ball 88 is positioned adjacent to the manifold discharge chamber outlet opening 83.

OPERATION

The operation of the pump installation 10 will be described with reference to FIGS. 2 through 5.

The design of the pump installation is such that no priming is required, for its operation. With the installation at the work site, the hopper 18 is filled with premixed cement, or other flowable material, and the valve ball stops 66 and 68 are set for the viscosity of the material to be pumped. When a discharge hose has been connected to the discharge pipe 20, the piston discharge means is activated.

The drawings illustrate a condition of the pump in which the piston 28 of the pump 12 is undergoing a discharge stroke, while the piston 32 of the pump 14 is simultaneously undergoing a suction stroke. As depicted in FIG. 3 and 4, the suction created in the cylinder 26 causes the valve ball 56 to be withdrawn from the spherical ball valve seat 60 allowing cement to be drawn from the hopper 18, through the manifold pump response chamber 52, and into cylinder 26 via its end opening 38. Valve ball 56 is depicted in its maximum open position in FIG. 4, resting on the valve ball stop 68. Simultaneously, as illustrated in FIGS. 2, 3 and 5, the discharge stroke of pump 12 causes cement flow under pressure into the manifold pump response chamber 50. This forces valve ball 54 against the valve seat 58 and closes the chamber 50 inlet connection from the hopper 18. The pressurized cement from pump 12 then flows through the discharge chamber isolation valve seat member 84 and into the discharge chamber 82 where it forces valve ball 88 against the discharge chamber isolation valve seat of member 86. This action closes the flow path between the manifold discharge chamber 82 and the pump response chamber 52 to prevent both interference with the suction stroke of pump 14 and the diversion of the cement flow through the discharge chamber outlet 83 and the pump installation discharge pipe 20.

While the present invention has been illustrated and described by means of a particular embodiment and application, it is to be understood that chambers and modifications may be made therein without departing from the spirit and scope of the invention as defined in the appended claims.

Having described my invention, what is claimed is:

1. A cement pump comprising:

a hopper for containing flowable material to be pumped;

pump means for receiving the flowable material from said hopper and discharging the flowable material under pressure, said pump means comprising a pair of parallel spaced apart pump cylinders with pistons reciprocatively slidable therein, each of said cylinders having outlets at one end through which the flowable material is received and discharged, and power means operatively connected to said pistons for simultaneously reciprocating said pistons in opposite directions within said pump cylinders;

manifold means interconnecting said hopper and said pump means, and including a flowable material discharge outlet, a first internal pump response chamber in flow communication with one of said pump cylinder outlets and having an inlet opening communicating with said hopper, a second internal pump response chamber in flow communication with the other of said pump cylinder outlets and having a second inlet opening in communication with said hopper, said hopper being positioned directly above said two pump response chambers and having a single outlet connected to both of said inlet openings;

first and second inlet valve means within said first and second pump response chambers, respectively, for controlling the opening of said first and second inlet openings to allow passage of flowable material from said hopper to said pump response chambers, an internal discharge chamber in flow communication with said first and second pump response chambers and said manifold discharge outlet, and outlet valve means within said discharge chamber for alternately isolating the flow of flowable material from said first and second pump response chambers to said discharge outlet in response to pumping action of said pump means;

each inlet valve means comprising a valve ball and a valve stop positioned beneath and spaced from the respective inlet opening, the valve ball being movable between the valve stop and the respective inlet opening in response to pumping action of the respective piston, the valve stop including adjusting means for varying the vertical position of the respective valve stop and the travel of the valve ball to adjust the flow of material from the hopper into said pump response chamber;

each valve stop having a valve stem which extends through the manifold wall, the wall having corresponding openings opposite the respective inlet openings for receiving the respective stems, the adjusting means comprising external operating means connected to the projecting end of each valve stem for operator control to vary the vertical position of the valve stop in the respective pump response chamber.

2. A cement pump as claimed in claim 1, wherein said outlet valve means comprises a valve ball and first and second valve seats having openings communicating with said first and second pump response chambers, respectively, the valve ball being movable between said first and second seats for alternately isolating the flow of material from said first and second chambers, respectively, in response to said pumping action.

3. A cement pump as claimed in claim 1, wherein said manifold means comprises a generally Y-shaped housing with the arms of the Y containing the respective first and second pump response chambers and the leg of the Y shape containing the discharge chamber, the Y-shape being bent in its longitudinal direction for directing the flow of material from the pump cylinder outlets through a substantially 90 degree turn into said discharge chamber.

4. A cement pump as claimed in claim 1, wherein the adjusting means provides an adjustment of the order of one inch in the vertical travel of the valve ball.

* * * * *